US007568485B2

(12) United States Patent
Zhang

(10) Patent No.: US 7,568,485 B2
(45) Date of Patent: Aug. 4, 2009

(54) SYSTEM FOR DISPERSING POWDER MATERIALS IN A CIGARETTE ROD

(75) Inventor: Wei-Jun Zhang, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 729 days.

(21) Appl. No.: 11/350,939

(22) Filed: Feb. 10, 2006

(65) Prior Publication Data

US 2006/0124142 A1 Jun. 15, 2006

Related U.S. Application Data

(62) Division of application No. 10/645,556, filed on Aug. 22, 2003, now Pat. No. 7,028,694.

(51) Int. Cl.
*A24C 5/32* (2006.01)

(52) U.S. Cl. ..... 131/301; 131/76; 131/290

(58) Field of Classification Search ..... 131/301, 131/290, 76, 200
See application file for complete search history.

(56) References Cited

U.S. PATENT DOCUMENTS

| | | | | |
|---|---|---|---|---|
| 3,298,115 | A * | 1/1967 | Dunn, Jr. | 434/335 |
| 3,720,214 | A | 3/1973 | Norman et al. | |
| 3,807,416 | A | 4/1974 | Hedge et al. | |
| 4,108,151 | A | 8/1978 | Martin et al. | |
| 4,182,348 | A | 1/1980 | Seehofer et al. | |
| 4,450,847 | A | 5/1984 | Owens | |
| 4,453,553 | A | 6/1984 | Cohn | |
| 4,744,374 | A | 5/1988 | Deffeves et al. | |
| 5,211,684 | A | 5/1993 | Shannon et al. | |
| 5,322,075 | A | 6/1994 | Deevi et al. | |
| 5,386,838 | A | 2/1995 | Quincy, III et al. | |
| 5,591,368 | A | 1/1997 | Fleischhauer et al. | |
| 5,671,758 | A | 9/1997 | Rongved | |
| 5,934,289 | A | 8/1999 | Watkins et al. | |
| 6,053,176 | A | 4/2000 | Adams et al. | |
| 6,138,684 | A | 10/2000 | Yamazaki et al. | |
| 6,286,516 | B1 | 9/2001 | Bowen et al. | |
| 6,371,127 | B1 | 4/2002 | Snaidr et al. | |
| 2002/0002979 | A1 | 1/2002 | Bowen et al. | |
| 2002/0062834 | A1 | 5/2002 | Snaidr et al. | |
| 2003/0037792 | A1 | 2/2003 | Snaidr et al. | |

FOREIGN PATENT DOCUMENTS

| | | |
|---|---|---|
| WO | WO 87/06104 | 10/1987 |
| WO | WO 00/40104 | 7/2000 |
| WO | WO 02/24005 A2 | 3/2002 |

* cited by examiner

*Primary Examiner*—Carlos Lopez
(74) *Attorney, Agent, or Firm*—Buchanan Ingersoll & Rooney PC

(57) ABSTRACT

A system and method is provided for dispersing fine catalyst powders having nanoscale or microscale particles throughout the tobacco rod portion of a cigarette. A source of vacuum is connected to the filter end of a cigarette through a tube that is sealingly engaged with the filter end of the cigarette. The opposite cut filler end of the tobacco rod portion of the cigarette is placed in the proximity of a predetermined amount of the catalyst powder contained in a container. The vacuum is applied to the cigarette filter in an amount and for a period of time that is a function of the size and quantity of the particles to be drawn into and dispersed throughout the tobacco rod portion of the cigarette.

6 Claims, 1 Drawing Sheet

SYSTEM FOR DISPERSING POWDER MATERIALS IN A CIGARETTE ROD

Figure 1:
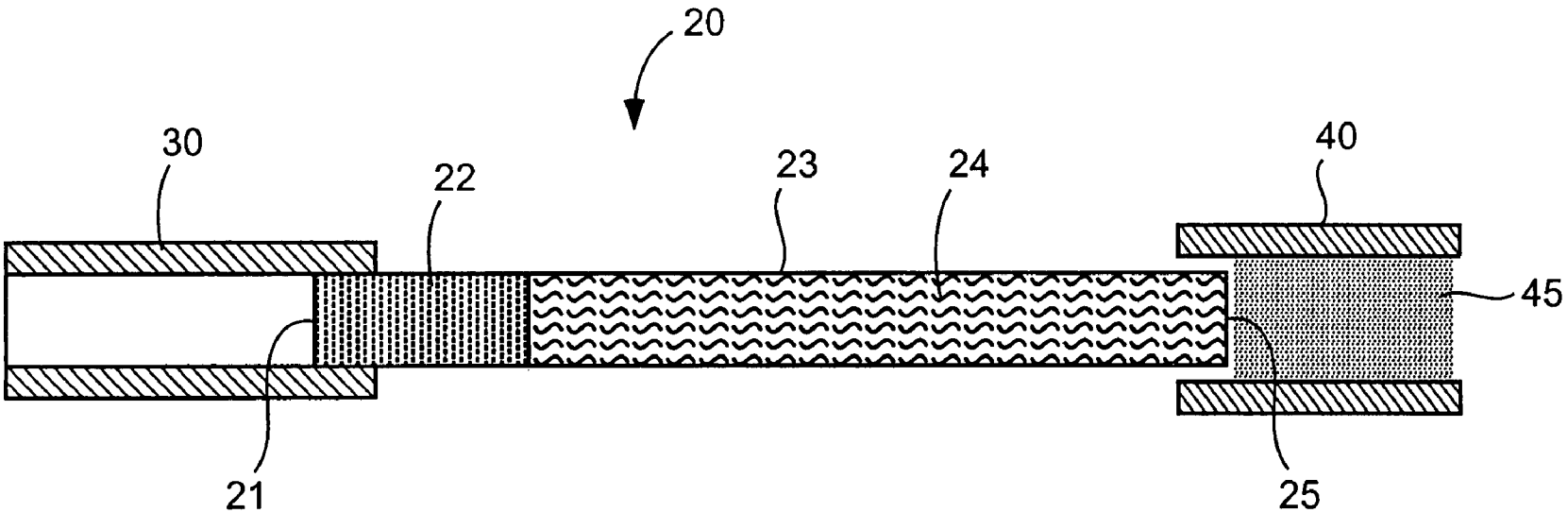

This application is a divisional application of U.S. Application Ser. No. 10/645,556 entitled SYSTEM FOR DISPERSING POWDER MATERIALS IN A CIGARETTE ROD, filed on Aug. 22, 2003, now U.S. Pat. No. 7,028,694, the entire content of which is hereby incorporated by reference.

BACKGROUND

The invention relates generally to methods for dispersing additives effective to reduce constituents such as carbon monoxide in cigarette smoke into the cigarettes. More specifically, the invention relates to methods for making cigarettes, which involve evenly dispersing very fine particles of additives capable of reducing the amounts of various constituents in tobacco smoke throughout the tobacco rod portion of a cigarette.

Smoking articles, such as cigarettes or cigars, produce both mainstream smoke during a puff and sidestream smoke during static burning. One constituent of both mainstream smoke and sidestream smoke is carbon monoxide (CO). The reduction of carbon monoxide in smoke is desirable.

Catalysts, sorbents, and/or oxidants for smoking articles, which contribute to the reduction of constituents in the smoke, such as carbon monoxide, are disclosed in the following: U.S. Pat. No. 6,371,127 issued to Snider et al., U.S. Pat. No. 6,286,516 issued to Bowen et al., U.S. Pat. No. 6,138,684 issued to Yamazaki et al., U.S. Pat. No. 5,671,758 issued to Rongved, U.S. Pat. No. 5,386,838 issued to Quincy, III et al., U.S. Pat. No. 5,211,684 issued to Shannon et al., U.S. Pat. No. 4,744,374 issued to Deffeves et al., U.S. Pat. No. 4,453,553 issued to Cohn, U.S. Pat. No. 4,450,847 issued to Owens, U.S. Pat. No. 4,182,348 issued to Seehofer et al., U.S. Pat. No. 4,108,151 issued to Martin et al., U.S. Pat. No. 3,807,416, and U.S. Pat. No. 3,720,214. Published applications WO 02/24005, WO 87/06104, WO 00/40104 and U.S. Patent Application Publication Nos. 2002/0002979 A1, 2003/0037792 A1 and 2002/0062834 A1 also refer to catalysts, sorbents, and/or oxidants.

SUMMARY

According to one embodiment, catalysts capable of converting carbon monoxide to carbon dioxide are provided in the form of a powder. The powder is dispersed throughout the tobacco cut filler in the tobacco rod portion of a cigarette by applying a vacuum at the filter end of the cigarette, while positioning the opposite tobacco rod end of the cigarette near and/or in fluid communication with the powder. The powder preferably comprises particles of catalyst such as micro-scale, or preferably nano-scale particles.

One embodiment provides a tobacco cut filler composition comprising tobacco and a nanoscale composite catalyst for the conversion of carbon monoxide to carbon dioxide, wherein the nanoscale composite catalyst comprises nanoscale metal particles and/or nanoscale metal oxide particles supported on nanoscale support particles. The nanoscale composite catalyst is preferably uniformly dispersed through the tobacco rod portion of a machine-made cigarette.

Cigarettes manufactured according to an embodiment preferably comprise up to about 200 mg of the catalyst per cigarette, and more preferably from about 10 mg to about 100 mg of the catalyst per cigarette. In one embodiment, 50 mg of CuO—$CeO_2$ nano-sized powder with particles in the size of 20-100 nm were dispersed preferably evenly throughout the tobacco rod portion of a machine-made cigarette. Preferably the nanoscale catalyst is added to the tobacco cut filler in a catalytically effective amount, i.e., an amount effective to convert at least about 10%, preferably at least about 25% of the carbon monoxide to carbon dioxide.

A further embodiment provides a method of ranking a cigarette, comprising (i) providing a cigarette having a cigarette filter at one end and a tobacco rod portion at the opposite end of the cigarette being filled with tobacco cut filler; (ii) positioning the cigarette with the filter end fitted and/or sealed in a vacuum tube, and the opposite cut filler end of the tobacco rod portion being placed near very fine catalyst particles, preferably micro-scale or nanoscale particles, or more preferably nanoscale particles; and (iii) drawing a vacuum at the filter end of the cigarette to cause the catalyst particles to be dispersed throughout the tobacco cut filler in the tobacco rod portion of the cigarette as a result of the negative pressure created in the cigarette.

In a preferred embodiment the nanoscale catalyst particles comprise metal particles and/or metal oxide particles that comprise transition, refractory and precious metals such as B, Mg, Al, Si, Ti, Fe, Co, Ni, Cu, Zn, Ge, Zr, Nb, Mo, Ru, Rh, Pd, Ag, Sn, Ce, Hf, Ta, W, Re, Os, Ir, Pt, Au and mixtures thereof. Nanoscale support particles comprise nanoscale particles of aluminum oxide, silicon oxide, titanium oxide, iron oxide, cobalt oxide, copper oxide, zirconium oxide cerium oxide, yttrium oxide optionally doped with zirconium, manganese oxide optionally doped with palladium, and mixtures thereof.

According to another preferred embodiment, the nanoscale metal particles and/or nanoscale metal oxide particles comprise Au and the nanoscale support particles comprise silicon oxide, titanium oxide, iron oxide and/or copper oxide. For example, the nanoscale composite catalyst can comprise from about 0.1 to 25 wt. % gold nanoscale particles supported on iron oxide nanoscale particles.

The nanoscale particles and the nanoscale support particles can have an average particle size less than about 100 nm, preferably less than about 50 nm, more preferably less than about 10 nm, and most preferably less than about 7 nm. The nanoscale composite catalyst is preferably carbon free.

BRIEF DESCRIPTION OF THE DRAWING FIGURES

FIG. 1 illustrates a system according to an embodiment of the invention wherein a cigarette is placed with the filter end in a vacuum tube and the opposite end near a supply of catalyst particles.

DETAILED DESCRIPTION OF THE PREFERRED EMBODIMENTS

"Smoking" of a cigarette means the heating or combustion of the cigarette to form smoke, which can be drawn through the cigarette. Generally, smoking of a cigarette involves lighting one end of the cigarette and, while the tobacco contained therein undergoes a combustion reaction, drawing the cigarette smoke through the mouth end of the cigarette. The cigarette may also be smoked by other means. For example, the cigarette may be smoked by heating the cigarette and/or heating using electrical heater means, as described in commonly-assigned U.S. Pat. Nos. 6,053,176; 5,934,289; 5,591,368 or U.S. Pat. No. 5,322,075.

The term "mainstream" smoke refers to the mixture of gases passing down the tobacco rod and issuing through the filter end, i.e. the amount of smoke issuing or drawn from the mouth end of a cigarette during smoking of the cigarette.

In addition to the constituents in the tobacco, the temperature and the oxygen concentration are factors affecting the formation and reaction of carbon monoxide and carbon dioxide. The total amount of carbon monoxide formed—during smoking comes from a combination of three main sources: thermal decomposition (about 30%), combustion (about 36%) and reduction of carbon dioxide with carbonized tobacco (at least 23%). Formation of carbon monoxide from thermal decomposition, which is largely controlled by chemical kinetics, starts at a temperature of about 180° C. and finishes at about 1050° C. Formation of carbon monoxide and carbon dioxide during combustion is controlled largely by the diffusion of oxygen to the surface ($k_a$) and via a surface reaction ($k_b$). At 250° C., $k_a$ and $k_b$, are about the same. At 400° C., the reaction becomes diffusion controlled. Finally, the reduction of carbon dioxide with carbonized tobacco or charcoal occurs at temperatures around 390° C. and above.

During smoking there are three distinct regions in a cigarette: the combustion zone, the pyrolysis/distillation zone, and the condensation/filtration zone. While not wishing to be bound by theory, it is believed that the nanoscale catalyst particles can target the various reactions that occur in different regions of the cigarette during smoking.

First, the combustion zone is the burning zone of the cigarette produced during smoking of the cigarette, usually at the lighted end of the cigarette. The temperature in the combustion zone ranges from about 700° C. to about 950° C., and the heating rate can be as high as 500° C./second. Because oxygen is being consumed in the combustion of tobacco to produce carbon monoxide, carbon dioxide, water vapor, and various organics, the concentration of oxygen is low in the combustion zone. The low oxygen concentrations coupled with the high temperature leads to the reduction of carbon dioxide to carbon monoxide by the carbonized tobacco. In this region, the nanoscale catalyst can convert carbon monoxide to carbon dioxide via both catalysis and oxidation mechanism. The combustion zone is highly exothermic and the heat generated is carried to the pyrolysis/distillation zone.

The pyrolysis zone is the region behind the combustion zone, where the temperatures range from about 200° C. to about 600° C. The pyrolysis zone is where most of the carbon monoxide is produced. The major reaction is the pyrolysis (i.e. the thermal degradation) of the tobacco that produces carbon monoxide, carbon dioxide, smoke components, and charcoal using the heat generated in the combustion zone. There is some oxygen present in this region, and thus the nanoscale catalyst may act as a catalyst for the oxidation of carbon monoxide to carbon dioxide. The catalytic reaction begins at 150° C. and reaches maximum activity around 300° C.

In the condensation/filtration zone the temperature ranges from ambient to about 150° C. The major process in this zone is the condensation/filtration of the smoke components. Some amount of carbon monoxide and carbon dioxide diffuse out of the cigarette and some oxygen diffuses into the cigarette. The partial pressure of oxygen in the condensation/filtration zone does not generally recover to the atmospheric level.

The nanoscale composite catalyst comprises metal and/or metal oxide nanoscale particles supported on nanoscale support particles. Nanoscale particles are a novel class of materials whose distinguishing feature is that their average grain or other structural domain size is below 100 nanometers. The nanoscale particles can have an average particle size less than about 100 nm, preferably less than about 50 nm, more preferably less than about 10 nm, and most preferably less than about 7 nm. Nanoscale particles have very high surface area to volume ratios, which makes them attractive for catalytic applications. The nanoscale particle size can be measured using transmission electron microscopy (TEM).

The support can comprise inorganic oxide materials such as silica gel, iron oxide, titanium oxide, aluminum oxide or other material. The synergistic combination of catalytically active nanoscale particles with a catalytically active (nanoscale) support can produce a more efficient catalyst. Thus, nanoscale particles advantageously allow for the use of smaller quantities of material as compared with conventional catalysts to catalyze, for example, the oxidation of CO to $CO_2$.

The nanoscale composite catalyst comprises metal and/or metal oxide particles and a support that may be made using any suitable technique, or the constituents can be purchased from a commercial supplier. For instance, MACH I, Inc., King of Prussia, Pa. sells $Fe_2O_3$ nanoscale particles under the trade names NANOCAT® Superfine Iron Oxide (SFIO) and NANOCAT® Magnetic Iron Oxide. The NANOCAT® Superfine Iron Oxide (SFIO) is amorphous ferric oxide in the form of a free flowing powder, with a particle size of about 3 nm, a specific surface area of about 250 $m^2/g$, and a bulk density of about 0.05 g/ml. The NANOCAT® Superfine Iron Oxide (SFIO) is synthesized by a vapor-phase process, which renders it free of impurities that may be present in conventional catalysts, and is suitable for use in food, drugs, and cosmetics. The NANOCAT® Magnetic Iron Oxide is a free flowing powder with a particle size of about 25 nm and a surface area of about 40 $m^2/g$. According to a preferred embodiment, nanoscale metal particles, such as nanoscale noble metal particles, can be supported on nanoscale iron oxide particles.

According to one method, commercially available metal and/or metal oxide nanoscale particles such as nanoscale gold, copper, copper-zinc and/or silver particles can be intimately mixed with a dispersion of a support material such as colloidal silica, which can be gelled in the presence of an acid or base and allowed to dry such as by drying in air. Acids and bases that can be used to gel the colloidal mixture include hydrochloric acid, acetic acid, formic acid, nitric acid, ammonium hydroxide, and the like. The colloidal support can be any suitable concentration such as, for example, 10 to 60 wt. %, e.g., a 15 wt. % dispersion or a 40 wt. % dispersion. When an acid containing chlorine is used, preferably the gel is washed in de-ionized water before drying in order to reduce the concentration of chloride ions in the gel.

According to a second method, nanoscale particles can be formed in situ upon heating a mixture of a suitable metal precursor compound and support. By way of example, metal and/or metal oxide precursor compounds such as gold hydroxide, silver pentane dionate, copper (II) pentane dionate, copper oxalate-zinc oxalate, or iron pentane dionate can be dissolved in a suitable solvent such as alcohol and mixed with a support material such as colloidal silica. During or after gelation, the metal precursor-colloidal silica mixture can be heated to a relatively low temperature, for example 200-400° C., wherein thermal decomposition of the metal precursor results in the formation of nanoscale metal and/or metal oxide particles supported on the silica support. In place of colloidal silica, colloidal titania or a colloidal silica-titania mixture can be used as a support.

Alternatively, both the nanoscale support particles and the metal and/or metal oxide nanoscale particles can be formed in situ upon heating a mixture of suitable metal precursor compounds. For example, a metal precursor such as gold hydroxide, silver pentane dionate, copper (II) pentane dionate, copper oxalate-zinc oxalate, or iron pentane dionate can be dissolved in a suitable solvent such as alcohol and mixed with a second metal precursor (e.g., a support precursor) such as titanium pentane dionate, iron pentane dionate, iron oxalate or other oxide precursor. The metal precursor mixture can be heated to a relatively low temperature, for example 200-400° C., wherein thermal decomposition of the metal precursors results in the formation of nanoscale metal and/or metal oxide particles supported on nanoscale oxide support particles.

Molecular organic decomposition (MOD) can be used to prepare nanoscale particles. The MOD process starts with a metal precursor containing the desired metallic element dissolved in a suitable solvent. The process can involve a single metal precursor bearing one or more metallic atoms or the process can involve multiple single metallic precursors that are combined in solution to form a solution mixture. As described above, MOD can be used to prepare nanoscale metal particles and/or nanoscale metal oxide particles, with or without the support.

The decomposition temperature of the metal precursor is the temperature at which the ligands substantially dissociate (or volatilize) from the metal atoms. During this process the bonds between the ligands and the metal atoms are broken such that the ligands are vaporized or otherwise separated from the metal. Preferably all of the ligand(s) decompose. However, nanoscale particles may also contain carbon obtained from partial decomposition of the organic or inorganic components present in the metal precursor and/or solvent. Preferably the nanoscale particles are essentially carbon free.

The metal precursors used in MOD processing preferably are high purity, non-toxic, and easy to handle and store (with long shelf lives). Desirable physical properties include solubility in solvent systems, compatibility with other precursors for multi-component synthesis, and volatility for low temperature processing.

Nanoscale particles can be obtained from mixtures of metal precursors or from single-source metal precursor molecules in which one or more metallic elements are chemically associated. The desired stoichiometry of the resultant particles can match the stoichiometry of the metal precursor solution.

An aspect of the method described herein for making a nanoscale composite catalyst is that a commercially desirable stoichiometry can be obtained. For example, the desired atomic ratio in the catalyst can be achieved by selecting a metal precursor or mixture of metal precursors having a ratio of first metal atoms to second metal atoms that is equal to the desired atomic ratio.

The metal precursor compounds are preferably metal organic compounds, which have a central main group, transition, lanthanide, or actinide metal atom or atoms bonded to a bridging atom (e.g., N, O, P or S) that is in turn bonded to an organic radical. Examples of the main group metal atom include, but are not limited to, B, Mg, Al, Si, Ti, Fe, Co, Ni, Cu, Zn, Ge, Zr, Nb, Mo, Ru, Rh, Pd, Ag, Sn, Ce, Hf, Ta, W, Re, Os, Ir, Pt and Au. Such compounds may include metal alkoxides, β-diketonates, carboxylates, oxalates, citrates, metal hydrides, thiolates, amides, nitrates, carbonates, cyanates, sulfates, bromides, chlorides, and hydrates thereof. The metal precursor can also be a so-called organometallic compound, wherein a central metal atom is bonded to one or more carbon atoms of an organic group. Aspects of processing with these metal precursors are discussed below.

Precursors for the synthesis of nanoscale oxides are molecules having pre-existing metal-oxygen bonds such as metal alkoxides $M(OR)_n$ or oxoalkoxides $MO(OR)_n$, R=saturated or unsaturated organic group, alkyl or aryl, β-diketonates $M(\beta\text{-diketonate})_n$ (β-diketonate=RCOCHCOR') and metal carboxylates $M(O_2CR)_n$. Metal alkoxides have both good solubility and volatility and are readily applicable to MOD processing. Generally, however, these compounds are highly hygroscopic and require storage under inert atmosphere. In contrast to silicon alkoxides, which are liquids and monomeric, the alkoxides based on most metals are solids. On the other hand, the high reactivity of the metal-alkoxide bond can make these metal precursor materials useful as starting compounds for a variety of heteroleptic species (i.e., species with different types of ligands) such as $M(OR)_{n-x}Z_x$ (Z=β-diketonate or $O_2CR$).

Metal alkoxides $M(OR)_n$ react easily with the protons of a large variety of molecules. This allows easy chemical modification and thus control of stoichiometry by using, for example, organic hydroxy compounds such as alcohols, silanols ($R_3SiOH$), glycols $OH(CH_2)_nOH$, carboxylic and hydroxycarboxylic acids, hydroxyl surfactants, etc.

Fluorinated alkoxides $M(OR_F)_n$ ($R_F$=$CH(CF_3)_2$, $C_6F_5$, . . . ) are readily soluble in organic solvents and less susceptible to hydrolysis than classical alkoxides. These materials can be used as precursors for fluorides, oxides or fluoride-doped oxides such as F-doped tin oxide, which can be used as metal oxide nanoscale particles and/or as a nanoscale support.

Modification of metal alkoxides reduces the number of M-OR bonds available for hydrolysis and thus hydrolytic susceptibility. Thus, it is possible to control the solution chemistry in situ by using, for example, β-diketonates (e.g. acetylacetone) or carboxylic acids (e.g. acetic acid) as modifiers for, or in lieu of, the alkoxide.

Metal β-diketonates $[M(RCOCHCOR')_n]_m$ are attractive precursors for MOD processing because of their volatility and high solubility. Their volatility is governed largely by the bulk of the R and R' groups as well as the nature of the metal, which will determine the degree of association, m, represented in the formula above. Acetylacetonates (R=R'=$CH_3$) are advantageous because they can provide good yields.

Metal β-diketonates are prone to a chelating behavior that can lead to a decrease in the nuclearity of these precursors. These ligands can act as surface capping reagents and polymerization inhibitors. Thus, small particles can be obtained after hydrolysis of $M(OR)_{n-x}(\beta\text{-diketonate})_x$. Acetylacetone can, for instance, stabilize nanoscale colloids. Thus, metal β-diketonate precursors are preferred for preparing nanoscale particles.

Metal carboxylates such as acetates ($M(O_2CMe)_n$) are commercially available as hydrates, which can be rendered anhydrous by heating with acetic anhydride or with 2-methoxyethanol. Many metal carboxylates generally have poor solubility in organic solvents and, because carboxylate ligands act mostly as bridging-chelating ligands, readily form oligomers or polymers. However, 2-ethylhexanoates ($M(O_2CCHEt_nBu)_n$), which are the carboxylates with the smallest number of carbon atoms, are generally soluble in most organic solvents. A large number of carboxylate derivatives are available for aluminum. Nanoscale aluminum-oxygen macromolecules and clusters (alumoxanes) can be used as catalyst materials. For example, formate $Al(O_2CH)_3(H_2O)$ and carboxylate-alumoxanes $[AlO_x(OH)_y(O_2CR)_z]_m$ can be prepared from the inexpensive minerals gibsite or boehmite.

Multicomponent materials can be prepared from mixed metal (hetero-metallic) precursors or, alternatively, from a mixture of single metal (homo-metallic) precursors.

The use of multiple single-metal precursors has the advantage of flexibility in designing precursor rheology as well as product stoichiometry. Hetero-metallic precursors, on the other hand, may offer access to metal systems whose single metal precursors have undesirable solubility, volatility or compatibility.

Mixed-metal species can be obtained via Lewis acid-base reactions or substitution reactions by mixing alkoxides and/or other metal precursors such as acetates, β-diketonates or nitrates. Because the combination reactions are controlled by thermodynamics, however, the stoichiometry of the hetero-compound once isolated may not reflect the composition ratios in the mixture from which it was prepared. On the other hand, most metal alkoxides can be combined to produce hetero-metallic species that are often more soluble than the starting materials.

The solvent(s) used in MOD processing are selected based on a number of criteria including high solubility for the metal precursor compounds; chemical inertness to the metal precursor compounds; Theological compatibility with the deposition technique being used (e.g. the desired viscosity, wettability and/or compatibility with other rheology adjusters); boiling point; vapor pressure and rate of vaporization; and economic factors (e.g. cost, recoverability, toxicity, etc.).

Solvents that may be used in MOD processing include pentanes, hexanes, cyclohexanes, xylenes, ethyl acetates, toluene, benzenes, tetrahydrofuran, acetone, carbon disulfide, dichlorobenzenes, nitrobenzenes, pyridine, methyl alcohol, ethyl alcohol, butyl alcohol, and mineral spirits.

According to another method, nanoscale particles of metals and/or metal oxides can be formed on a nanoscale support, such as an iron oxide support. Suitable precursor compounds for the metal, metal oxide and iron oxide are those that thermally decompose at relatively low temperatures, such as discussed above. According to an embodiment, a metal precursor solution can be combined with an iron oxide support. The support can be commercially available nanoscale particles, such as nanoscale iron oxide particles, or the support can be prepared from a colloidal solution or metal precursor solution as described above.

A metal precursor solution may be contacted with a support in a number of ways. For example, the metal precursor may be dissolved or suspended in a liquid, and the support may be mixed with the liquid having the dispersed or suspended metal precursor. The dissolved or suspended metal precursor can be adsorbed onto a surface of the support or absorbed into the support. The metal precursor may also be deposited onto a surface of the support by removing the liquid, such as by evaporation so that the metal precursor remains on the support. The liquid may be substantially removed from the support during or prior to thermally treating the metal precursor, such as by heating the support at a temperature higher than the boiling point of the liquid or by reducing the pressure of the atmosphere surrounding the support.

Thermal treatment causes decomposition of the metal precursor to dissociate the constituent metal atoms, whereby the metal atoms may combine to form metal and/or metal oxide particles having an atomic ratio approximately equal to the stoichiometric ratio of the metal(s) in the metal precursor solution.

The support or support precursor can be contacted with a metal precursor solution and the contacted support can be heated in the substantial absence of an oxidizing atmosphere. Alternatively, the support or support precursor can be contacted with a metal precursor solution and the contacted support can be heated in the presence of an oxidizing atmosphere and then heated in the substantial absence of an oxidizing atmosphere.

The metal precursor-contacted support is preferably heated to a temperature equal to or greater than the decomposition temperature of the metal precursor. The preferred heating temperature will depend on the particular ligands used as well as on the degradation temperature of the metal(s) and any other desired groups which are to remain. However, the preferred temperature is from about 200° C. to 400° C., for example 300° C. or 350° C. The heating of the metal precursor-contacted support can occur in an oxidizing and/or reducing atmosphere.

Iron oxide nanoscale particles smaller than about 100 nm can be used as a support for nanoscale gold particles. As an example, iron oxide nanoscale particles having a size as small as 3 nm can be used as the support material. The Au—$Fe_2O_3$ nanoscale composite catalyst can be produced from gold hydroxide that is dissolved in alcohol and mixed with the iron oxide. Decomposition of the hydroxide into nanoscale gold particles, which can be intimately coated/mixed with the iron oxide nanoscale particles, can be caused by heating the mixture to 300 or 400° C.

In general, a metal precursor and a support can be combined in any suitable ratio to give a desired loading of metal particles on the support. Gold hydroxide and iron oxide can be combined, for example, to produce from about 1% to 25% wt. %, e.g., 2 wt. %, 5 wt. % or 15 wt. %, gold on iron oxide.

Other preferred support materials include $Cu_2O$, CuO, $SiO_2$, $TiO_2$, CoO, ZrO, $CeO_2$, $Ce_2O_3$, or $Al_2O_3$, or doped metal oxides such as $Y_2O_3$ optionally doped with zirconium, $Mn_2O_3$ optionally doped with palladium, and mixtures thereof. The support may include substantially any material which, when heated to a temperature at which a metal precursor is converted to a metal and/or metal oxide on the surface thereof, does not melt, vaporize completely, or otherwise become incapable of supporting nanoscale particles.

During the conversion of CO to $CO_2$, the nanoscale composite catalyst may become reduced. For example, $Fe_2O_3$, which may comprise the catalyst, the support or particles dispersed on a support, may be reduced to $Fe_3O_4$ or FeO during the reaction of CO to $CO_2$.

Iron oxide is a preferred constituent in the composite because it has a dual function as a CO catalyst in the presence of oxygen and as a CO oxidant for the direct oxidation of CO in the absence of oxygen. A catalyst that can also be used as an oxidant is especially useful for certain applications, such as within a burning cigarette where the partial pressure of oxygen can be very low.

A catalyst is capable of affecting the rate of a chemical reaction, e.g., increasing the rate of oxidation of carbon monoxide to carbon dioxide and/or increasing the rate of reduction of nitric oxide to nitrogen without participating as a reactant or product of the reaction. An oxidant is capable of oxidizing a reactant, e.g., by donating oxygen to the reactant, such that the oxidant itself is reduced.

The nanoscale composite catalysts will preferably be distributed throughout the tobacco rod portion of a cigarette. By providing the nanoscale composite catalysts throughout the tobacco rod, it is possible to reduce the amount of carbon monoxide drawn through the cigarette, and particularly at both the combustion region and in the pyrolysis zone.

The nanoscale composite catalysts, as described above, may be provided along the length of a tobacco rod by distributing the nanoscale composite catalysts on the tobacco or incorporating them into the cut filler tobacco using any suitable method. The nanoscale composite catalysts can also be incorporated in cigarette filter material that is used to make a cigarette filter. The nanoscale composite catalysts may be provided in the form of a powder or in a solvent in the form of a dispersion. Nanoscale composite catalysts in the form of a dry powder can be dusted on cut filler tobacco and/or cigarette filter material.

In one preferred embodiment, the nanoscale composite catalyst in the form of a powder can be dispersed throughout the tobacco cut filler in the tobacco rod by drawing a vacuum at the filter end of the cigarette while placing the opposite filler end of the cigarette near and/or in fluid communication with the powder. The uniformity of the powder dispersion throughout the tobacco cut filler can be optimized by adjusting the degree of vacuum applied at the filter end of the cigarette and the length of time the vacuum is maintained. The quantity of the powder that is drawn into the cigarette can also be controlled by the dose of powder provided in a container or some form of receptacle or dispenser placed near and/or in fluid communication with the filler end of the cigarette during the application of vacuum at the opposite filter end of the cigarette.

As shown in FIG. 1, a cigarette 20 comprises a filter 22 and a tobacco rod 23 filled with tobacco cut filler 24. The system shown allows for the preferably even dispersion of catalyst particles, and preferably nanoscale catalyst particles, throughout the tobacco cut filler 24 in the tobacco rod 23. The filter end 21 of the cigarette 20 is fitted and/or sealed in a vacuum tube 30, and the opposite filler end 25 is placed near and/or in fluid communication with a dose or predetermined amount of catalyst particles 45 contained within a container 40 or provided in some other form of receptacle or dispenser. A vacuum can then be applied at the filter end 21 to create a negative pressure in the cigarette, resulting in the catalyst particles 45 being pulled into the tobacco rod 23 from the container 40, other form of receptacle or dispenser, and dispersed, preferably evenly, throughout the tobacco cut filler 24.

In alternative embodiments, nanoscale, or at least microscale composite catalysts may also be present in the form of a dispersion and sprayed on the cut filler tobacco, cigarette paper and/or cigarette filter material. The nanoscale composite catalyst may also be added to the cut filler tobacco stock supplied to the cigarette making machine or added to a tobacco column prior to wrapping cigarette paper around the tobacco column. The catalysts may be added to paper stock of a cigarette papermaking machine or to cigarette filter material during or after processing of the cigarette filter material (e.g., during the manufacture of the cigarette filter material or during the manufacture of a cigarette filter comprising the cigarette filter material).

Any suitable tobacco mixture may be used for the cut filler. Examples of suitable types of tobacco materials include flue-cured, Burley, Maryland or Oriental tobaccos, the rare or specialty tobaccos, and blends thereof. The tobacco material can be provided in the form of tobacco lamina, processed tobacco materials such as volume expanded or puffed tobacco, processed tobacco stems such as cut-rolled or cut-puffed stems, reconstituted tobacco materials, or blends thereof. The invention may also be practiced with tobacco substitutes.

In cigarette manufacture, the tobacco is normally employed in the form of cut filler, i.e. in the form of shreds or strands cut into widths ranging from about 1/10 inch to about 1/20 inch or even 1/40 inch. The lengths of the strands range from between about 0.25 inches to about 3.0 inches. The cigarettes may further comprise one or more flavorants or other additives (e.g. burn additives, combustion modifying agents, coloring agents, binders, etc.) known in the art.

Techniques for cigarette manufacture are known in the art. Any conventional or modified cigarette making technique may be used to manufacture cigarettes that are then subjected to the above process to incorporate the catalyst in the cut filler. The resulting cigarettes can be manufactured to any known specifications using standard or modified cigarette making techniques and equipment. Typically, the cut filler composition is optionally combined with other cigarette additives, and provided to a cigarette making machine to produce a tobacco rod, which is then wrapped in cigarette paper, and optionally tipped with filters.

Cigarettes may range from about 50 mm to about 120 mm in length. Generally, a regular cigarette is about 70 mm long, a "King Size" is about 85 mm long, a "Super King Size" is about 100 mm long, and a "Long" is usually about 120 mm in length. The circumference is from about 15 mm to about 30 mm in circumference, and preferably around 25 mm. The packing density is typically between the range of about 100 $mg/cm^3$ to about 300 $mg/cm^3$, and preferably 150 $mg/cm^3$ to about 275 $mg/cm^3$.

The process of dispersing catalysts such as any of the above-described nanoscale composite catalysts, throughout the tobacco cut filler in the tobacco rod portion of the cigarette, can be controlled by varying the amount of vacuum that is applied to the filter end of the cigarette, and the period of time over which the vacuum is applied to the cigarette, as a function of the size of the catalyst particles that are being dispersed throughout the tobacco rod. As an example, it has been discovered that very fine catalyst particles such as those that are approximately 5 nm in size, are best dispersed throughout the tobacco rod by applying a relatively lower vacuum over a relatively longer period of time than when dispersing larger size particles.

In one embodiment, 50 mg of $CuO—CeO_2$ nano powders in the size of 20-100 nm are dispersed evenly throughout the tobacco rod portion of a cigarette by placing the 50 mg of nano powder in a container, placing the tobacco cut filler end of a machine-made cigarette in the container near the dose of powder, sealing the opposite filter end of the cigarette in a vacuum tube connected to a vacuum source, and applying vacuum to the cigarette to create a negative pressure in the cigarette for a predetermined period of time. The amount of vacuum applied to the filter end of the cigarette, the period of time the vacuum is applied, the size of the particles, and the quantity of particles can all be varied to achieve the desired dispersion of a catalyst throughout the tobacco rod portion of the cigarette. For smaller particles, such as particles approximately 5 nm in size, it has been discovered that a relatively low vacuum is preferably applied over a relatively longer period of time than is the case with larger particles to ensure that the particles are evenly dispersed throughout the tobacco rod portion of the cigarette, without being pulled completely through the cigarette.

Although the present invention has been described in connection with exemplary embodiments thereof, it will be appreciated by those skilled in the art that additions, deletions, modifications, and substitutions not specifically described may be made without departing from the spirit and scope of the invention as defined in the appended claims.

What is claimed is:

1. A system for dispersing catalyst particles throughout the tobacco rod portion of a machine-made cigarette having a filter at one end and a tobacco rod portion comprising tobacco cut filler, the tobacco rod portion being joined to the filter with tipping paper, the system comprising: a vacuum tube connected to a source of vacuum and adapted to form a fitted connection with the filter end of the cigarette; and a container, receptacle or dispenser for containing a predetermined quantity of the catalyst particles and positioning the particles in proximity to or in fluid communication with the cut filler end of the cigarette at the end of the tobacco rod portion of the cigarette opposite from the filter end of the cigarette.

2. The system according to claim 1, wherein said catalyst particles comprise metal particles that comprise transition, refractory and precious metals selected from the group consisting of B, Mg, Al, Si, Ti, Fe, Co, Ni, Cu, Zn, Ge, Zr, Nb, Mo, Ru, Rh, Pd, Ag, Sn, Ce, Hf, Ta, W, Re, Os, Ir, Pt, Au and mixtures thereof.

3. The system according to claim 1, wherein said catalyst particles are supported on nanoscale support particles comprising nanoscale particles selected from the group consisting of aluminum oxide, silicon oxide, titanium oxide, iron oxide, cobalt oxide, copper oxide, zirconium oxide, cerium oxide, yttrium oxide optionally doped with zirconium, manganese oxide optionally doped with palladium, and mixtures thereof.

4. The system according to claim 3, wherein 0.1 to 25 weight percent gold nanoscale particles are supported on iron oxide nanoscale support particles.

5. The system according to claim 3, wherein said catalyst particles and said nanoscale support particles have an average particle size less than approximately 100 nanometer.

6. The system according to claim 3, wherein said catalyst particles and said nanoscale support particles have an average particle size less than approximately 7 nanometer.

* * * * *